United States Patent [19]

Drexler

[11] 4,331,094

[45] May 25, 1982

[54] MAST BASE FOR A WIND SURF-BOARD

[75] Inventor: Ernst Drexler, Munich, Fed. Rep. of Germany

[73] Assignee: AKUTEC Angewandte Kunststoff-technik GmbH, Munich, Fed. Rep. of Germany

[21] Appl. No.: 145,301

[22] Filed: Apr. 30, 1980

[30] Foreign Application Priority Data

Apr. 30, 1979 [DE] Fed. Rep. of Germany ..... 2917585

[51] Int. Cl.[3] ..... B63B 15/00

[52] U.S. Cl. ..... 114/90; 441/74

[58] Field of Search ..... 114/90; 9/310 E; 24/257, 258, 735 A; 285/319, 81, 314, DIG. 22; 403/290, 361, 353, 366, 371, 297

[56] References Cited

U.S. PATENT DOCUMENTS

| | | | |
|---|---|---|---|
| 2,687,547 | 8/1954 | Matter | 403/297 |
| 3,413,021 | 11/1968 | Potts | 285/319 |
| 3,574,420 | 4/1971 | Waldmann | 403/361 |
| 3,645,569 | 2/1972 | Reilly | 403/366 |
| 4,152,086 | 5/1979 | Achenbach et al. | 403/297 |
| 4,161,375 | 7/1979 | Murphy | 403/353 |
| 4,236,476 | 12/1980 | Solf et al. | 9/310 E |

FOREIGN PATENT DOCUMENTS

| | | |
|---|---|---|
| 7634959 | 5/1977 | Fed. Rep. of Germany . |
| 7707496 | 8/1977 | Fed. Rep. of Germany . |
| 7709045 | 10/1977 | Fed. Rep. of Germany . |
| 7803617 | 8/1978 | Fed. Rep. of Germany . |

*Primary Examiner*—Trygve M. Blix
*Assistant Examiner*—C. T. Bartz
*Attorney, Agent, or Firm*—Scully, Scott, Murphy & Presser

[57] ABSTRACT

A mast base for a wind surf-board adapted to have a mast cardanically fastened thereto. The mast base is releasably latchable in a sleeve or in an aperture within the body of the sailing board or wind surf-board, and includes spring-elastically adjustable latching elements which engage in corresponding recesses in the sleeve or aperture within the wind surf-board. An externally manipulatable adjusting collar is connected to a clamping nut or toggle member to bias the latching elements so as to exert variably selectable latching forces.

8 Claims, 4 Drawing Figures

MAST BASE FOR A WIND SURF-BOARD

BACKGROUND OF THE INVENTION

1. Field of the Invention

The present invention relates to a mast base for a sailing board, commonly referred to as a wind surf-board, with which the mast is cardanically or universally connected, which is releasably latched in a sleeve or in an opening in the wind surf-board body and includes spring-elastically adjustable latching elements which engage in corresponding recesses in the sleeve or in the opening in the wind surf-board body.

2. Discussion of the Prior Art

A mast base of that type for a wind surf-board has already become known, for example, from German Petty Patent No. 7 709 045 wherein there is provided in the mast base one or more latches formed by a spring-loaded ball which engages in an annular groove in the sleeve within the body of the wind surf-board. The spring loading of the ball is adjustable through a set screw which is only accessible when the mast is not inserted. This known latching for the mast base of a wind surf-board through the intermediary of pre-stressed latching balls creates a good closely-fitted connection between the mast base and the wind surf-board; however, it is subject to the disadvantage that the force required for the latching engagement of the mast base in the sleeve is equal to that which the mast base opposes, for example, during strenuous sailing maneuvers, to the detachment of the mast base with the mast from the wind surf-board. This has the disadvantage that the force which has been set through the spring loading of the latching balls is either too small in order to be able to restrain the mast base during hard sailing maneuvers, or is too large to be able to release the latching engagement even under favorable conditions.

The same disadvantages are applicable to the mast anchoring for wind surfboards which has become known from German Petty Patent No. 7 803 617. In this mast anchoring an annular groove is provided in the cylindrical mast base, into which there engages a steel spring within the sleeve in the body of the wind surf-board.

On the other hand, mast anchorings have become known from German Petty Patent Nos. 7 707 496 and 7 634 959 in which a variable positive retention within the sleeve is to be achieved in that rubber-elastic components are adhered to between the mast base and the sleeve. In the first-mentioned Petty Patent this is effected through a rubber cylinder which is tied down by axial threading. In the second-mentioned Petty Patent a rubber ring is provided on the cylindrical mast base which, for adjusting of the clamping force, can be selectively snapped into notches at different depths of the mast base. Such clamping retentions for mast bases are disadvantageous since the clamping effect is dependent upon external conditions, such as temperature, moisture, penetrated dirt or salt encrustation in the use of the wind surf-board or sailing board in salty waters.

SUMMARY OF THE INVENTION

Accordingly, it is an object of the present invention to improve upon a mast base of the above-described type wherein at all times it is possible to externally adjust the latching forces to a predetermined good closely-fitted latching of the mast base, notwithstanding that the construction of the mast base is simple and unaffected by external influences.

The foregoing object is inventively attained for a mast base of the above-mentioned type in that the latching elements are formed as protuding latching detents at the lower ends of spring-elastic latching tongues extending in the inserting direction on the mast base and separated from each other by axial slots, and in which the spring-elasticity of the latching tongues in adjustable through a toggle member arranged interiorly on the mast base behind the latching tongues by means of a handgrip from externally thereof.

Through this construction there is achieved a close-fitting latching adjustable from the exterior in which, due to the adjustability of the spring-elastic latching tongues through an external manipulation, there becomes possible an easy insertion and removal of the mast base, and in which the mast base during use of the wind surf-board is restrained with sufficient force and remains anchored even under the most adverse conditions. In other words, for the utilized condition of the mast base, the latching tongues, are practically locked through the toggle member.

Thus, spring-elastic latching tongues on the mast base of a wind surf-board which has become known through practical realization have also become known. Latching forces of different strengths for the insertion of the mast base, in essence, for the restraint thereof during use are, however, produced when the latching detents on the latching tongues and the associated contact surfaces in the recesses of the sleeve are alternatingly differently shaped so that, in accordance with the rotational position of the mast base with respect to the sleeve, a larger or smaller resistance is offered against disengagement.

In a particular embodiment of the invention, a further advantage is derived in that a rotationally fixed but axially displaceable arrangement of the toggle member on a setting rod and with an adjusting collar rotatable about a limited angle facilitates that, through adjustment of the axial position of the toggle member on the setting rod, there can be preselected the range of adjustment for the latching forces. The spring-elastically effective length of the latching tongues is varied through the axial position of the toggle member.

In another embodiment of the invention, the toggle member or clamping nut is fixedly arranged on the setting rod and the adjusting collar is axially displaceable to an extent together with the setting rod and the clamping nut with respect to the cylindrical member forming the mast base. Thus, the variation in the latching forces is based on influencing the spring-elastically effective length of the latching tongues.

BRIEF DESCRIPTION OF THE DRAWINGS

Reference may now be had to the following detailed description of a preferred embodiment of the invention, taken in conjunction with the accompanying drawings; in which.

DETAILED DESCRIPTION

Figure 1:
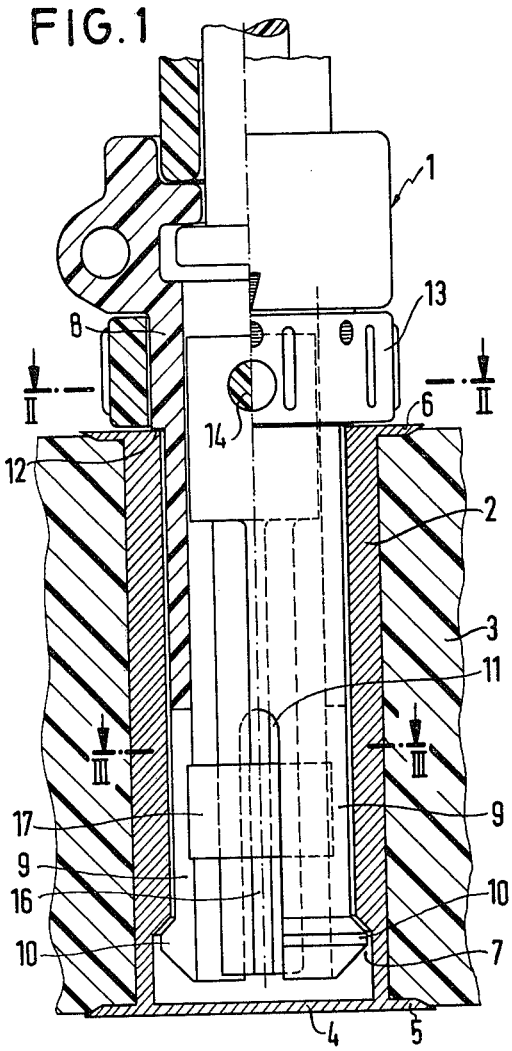
FIG. 1 is a partially sectioned longitudinal view of a mast base positioned with a sailing board or wind surf-board.

Pursuant to FIG. 1, the mast base which is designated by reference numeral 1 is inserted in a sleeve 2 which is arranged within the body 3 of a sailing board or wind surf-board. The exemplary illustrated sleeve 2 is closed at its lower end through a plate 4 which is screwed together with the sleeve body, and is retained in the board body 3 through the intermediary of a flange 5 on the plate 4 as well as an upper flange 6 on the sleeve body 2. A recess 7 is provided within the sleeve 2 in which there engages the hereinbelow described latching detents.

Figure 2:
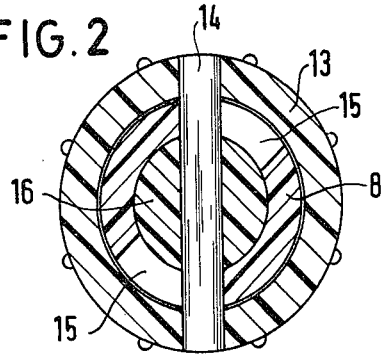
FIG. 2 is a sectional view taken along line II—II in FIG. 1.

The mast base which is generally designated by reference numeral 1 consists of an essentially cylindrical plastic material body 8 which, in the lower region thereof determined to be received within the sleeve 2, includes stop tongues 9 having outwardly protruding latching detents 10 at their lower ends. The four latching tongues 9 present in the illustrated embodiment are separated from each other through axial slots 11. In the illustrated inserted position of the mast base 1 in the sleeve 2, a shoulder 12 of the cylindrical body 8 rests on the upper edge of the sleeve 2 and the latching detents 10 project into the recess 7. The cylindrical body 8 supports an adjusting ring 13 forming a handgrip directly above the shoulder 12 which adjusting ring, pursuant to FIG. 2, is rotatably supported through a pin 14 relative to the cylindrical body 8 over slots 15 extending across a limited circumferential area of the cylindrical body 8. The length of the slots 15 determines the permissible range of rotation for the adjusting collar 13. Furthermore, a setting rod 16 is fastened to the pin 14 within the cylindrical body 8, which projects downwardly through the cylindrical body 8 and has approximately the length of the retaining tongues 9. Arranged on the setting rod 16, which as shown in FIGS. 3 and 4 is constructed star-shaped in its lower region, is a toggle member or clamping nut 17 which is not fixed against rotation and is fully displaceable in an axial direction.

The upper region of the mast base 1 or of the cylindrical body 8 is not described in greater detail herein since the type of the cardanic or universal connection between the mast base and the mast is not of significance to the present invention.

Figure 3:
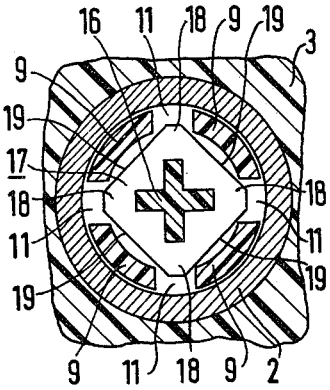
FIG. 3 is a sectional view taken along line III—III in FIG. 1.
Figure 4:
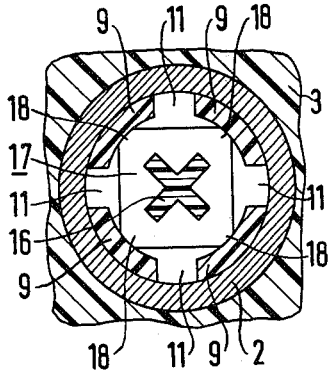
FIG. 4 is the sectional view of FIG. 3 with the clamping nut shown in the locking position.

As may be ascertained from FIGS. 3 and 4, the clamping nut 17 is constructed square in cross-section and having flattened corners. In a first rotational position of the clamping nut 17, set by means of the hand grip 13 through the setting rod 16, the edges or corners 18 which in their entirety can be designated as projections with respect to the clamping nut 17, are against the latching tongues 9 or are in the axial slots 11. The mast base can be inserted into the sleeve 2 wherein only the spring forces of the latching tongues 9 must be overcome for the insertion of the latching detents 10 through the sleeve 2 down to the recess 7. The latching tongues 9 yield inwardly wherein their elastic temper is determined through the preselectable axial position (elevational position in FIG. 1) of the clamping nut 17 on the setting rod 16. The latching tongues 9 can spring inwardly only to such an extent until they contact against the side surfaces 19 of the clamping nut 17 so that then only the remaining free length of the tongues 9 come into consideration for a resilient yielding.

In the second rotational position of the clamping nut 17, ascertainable from FIG. 4, which is set by the adjusting collar through the setting rod 16, the edges 18 are each presently pressed against behind one of the tongues 9. The latching tongues 9 are maintained outwardly pressed so that the latching detents 10 are fixedly positioned within the recess 7 of the sleeve 2. The mast base 1 is retained within the sleeve 2 with a high latching force.

What is claimed is:

1. In a mast base for a wind surfboard having a mast cardanically connected thereto; said wind surfboard having a sleeve in the surfer board body, said mast base being releasably latched in said sleeve and having spring-elastically adjustable latching means engageable in conforming recesses in said sleeve of the wind surfboard, the improvement comprising: spring-elastic latching tongues insertable into said sleeve, axial slots separating said latching tongues from each other, said latching means including protruding latching detents formed at the lower ends of said tongues extending in the inserting direction on said mast base; clamping means located within said mast base behind said latching tongues; and handgrip means for varying the spring elasticity of said latching tongues from externally of said mast base through manipulation of said clamping means upon said mast base being inserted into said sleeve in said wind surfboard.

2. Mast base as claimed in claim 1, said mast base being a plastic material hollow member, said latching tongues being unitarily formed at the lower region thereof, a shoulder being formed in the upper region thereof adapted to seat on the upper edge of said sleeve so as to limit the extent of insertion of said mast base, said handgrip being located above said shoulder.

3. Mast base as claimed in claim 1 or 2, said mast base being a hollow cylindrical member; said handgrip comprising an adjusting collar; a setting rod axially extending within said cylindrical member and being connected with said adjusting collar; said clamping means being supported on setting rod.

4. Mast base as claimed in claim 3, said adjusting collar and said setting rod being rotatable through a limited angle relative to said cylindrical member, said clamping means including a plurality of protuberances radially extending from said setting rod, said protuberances being distributed about the circumference of said clamping means and being equal in number to the number of said latching tongues, said protuberances in a first rotational position of said adjusting collar being located opposite said axial slots and in a second rotation position each said protuberance contacting against respectively one of said latching tongues.

5. Mast base as claimed in claim 4, said clamping means being a generally multi-cornered member in cross-section, said protuberances being formed by said corners.

6. Mast base as claimed in claim 4, said clamping means being rotationally fixed and axially slideably mounted on said setting rod.

7. Mast base as claimed in claim 1, said clamping means comprising an elastic plastic material member.

8. Mast base as claimed in claim 3 wherein said clamping means is fixedly mounted on said setting rod and said adjusting collar is axially displaceable to an extent together with said setting rod and said clamping means relative to the cylindrical member forming said mast base.

* * * * *